United States Patent [19]

Camardella

[11] Patent Number: 4,722,486

[45] Date of Patent: Feb. 2, 1988

[54] METHOD AND APPARATUS FOR SIMULTANEOUSLY WINDING MULTIPLE COILS

[75] Inventor: Giuseppe Camardella, Saronno, Italy

[73] Assignee: Tekma Kinomat S.p.A., Caronno Pertusella, Italy

[21] Appl. No.: 790,232

[22] Filed: Oct. 22, 1985

[30] Foreign Application Priority Data

Oct. 26, 1984 [IT] Italy ..... 23327 A/84

[51] Int. Cl.[4] ..... H01F 41/06

[52] U.S. Cl. ..... 242/7.03; 140/92.2; 242/7.09; 242/7.11

[58] Field of Search ..... 242/7.03, 7.08, 7.09, 242/7.11; 156/187, 188, 446; 140/92.2; 29/605, 729, 745

[56] References Cited

U.S. PATENT DOCUMENTS

| | | | |
|---|---|---|---|
| 3,101,180 | 8/1963 | Sadorf | 242/7.09 |
| 3,314,452 | 4/1967 | Cartwright et al. | 242/7.09 |
| 3,658,269 | 4/1972 | Giuseppe | 242/7.11 |
| 4,055,310 | 10/1977 | Bonaiti | 242/7.08 |

FOREIGN PATENT DOCUMENTS 2322064 11/1973 Fed. Rep. of Germany .

*Primary Examiner*—Billy S. Taylor

*Attorney, Agent, or Firm*—Young & Thompson

[57] ABSTRACT

The coil winder is of the type comprising at least two sets of spindles for coil support, rotating about parallel axes and mounted on two opposite surfaces of a bed tilting by 180°, this latter rotating about a horizontal axis which is transverse to the axes of the spindles. Two motion transmissions are provided on the tilting bed to independently drive the spindles of a first set and, respectively, the spindles of a second set. While the coils supported by the first set of spindles are being wound, the spindles of the second set are in a waiting position for loading or unloading the coils. According to the invention, an intermediate and/or supplementary working stage is carried out on the coils mounted on the spindles of the second set, taking advantage of the waiting period. For this purpose, operating devices are associated also with the front part of the coil winder and comprise first of all a secondary motor—positioned symmetrically to the main motor unit controlling the winding of the coils on the spindles of the first set—which act on the motion transmission driving the spindles of the second set.

5 Claims, 5 Drawing Figures

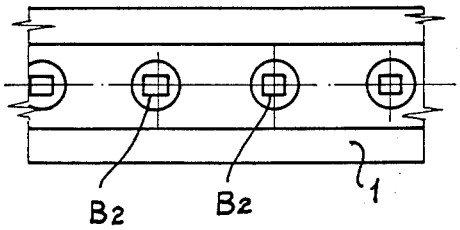
Fig. 2B
Fig. 2A
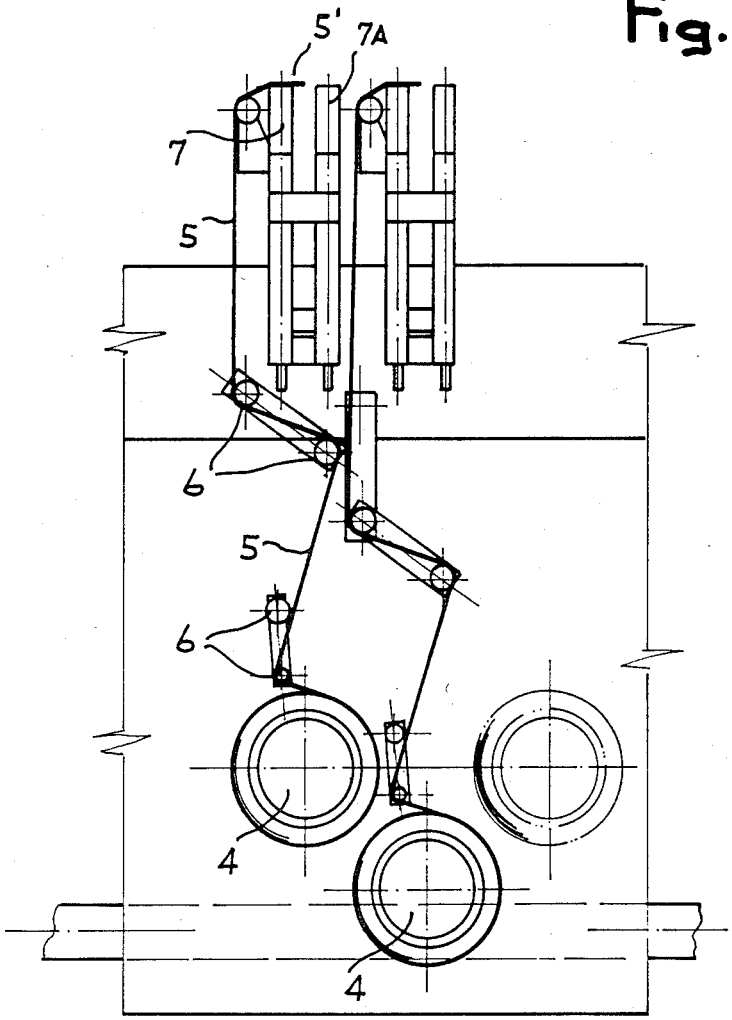

METHOD AND APPARATUS FOR SIMULTANEOUSLY WINDING MULTIPLE COILS

BACKGROUND OF THE INVENTION

The present invention relates to coil winders, and particularly those designed to produce coils for use in the electric and/or electronic field.

As is known, there are a wide variety of coil winders which comprise, on the one hand, coil winders with revolving turret and, on the other hand, coil winders in line. In the coil winders with revolving turret—of which an example is provided in the West German Pat. No. 2,322,064 in the name of the same Applicant—the coils are mounted on spindles radially projecting from a rotary indexing turret, so that the single coils are moved forward through successive working stations, for instance at least one loading station, a winding station and an unloading station, in addition to one or more supplementary or finishing working stations; thus, when the coils are unloaded, they are substantially finished and ready for use. Another type of turret coil winder, designed to produce coils with few turns, having very special functions, is described for example in the EP-A No. 2-120168 in the name of GRUMMAN AEROSPACE CORP.

In the coil winders in line—which also include the machine according to the present invention—the coils are instead carried by a plurality of spindles with parallel axes, which are mounted for rotation on a single support bed or crosspiece, with their axis transverse to that of the spindles. These coil winders merely provide to load, wind and unload the coils; any supplementary or finishing operations on the coils are not carried out on the coil winder in line, but on other machines positioned downstream thereof.

Coil winders of this type are widely known, especially for producing coils with fairly simple winding and with a large number of turns, at high production rates. In these machines, the support spindles have a simple, high-speed rotary motion, a wireguide cooperating with each spindle to distribute the wire on the coil winding, said wireguide having a main back and forth motion along the spindle axis. Preferably, such wireguides are also adapted to perform a more complex motion—usually under numerical control—in order to twist the winding ends on the coil terminals.

In the more modern coil winders, the bed supporting the spindles is rotatable about a horizontal, longitudinal axis of the machine, in order to take up two working positions rotated by 180° one in respect of the other, and the two opposite surfaces of the bed carry two respective sets of spindles, with axes perpendicular to that of the bed, each spindle of one set being coaxial with but independent from a spindle of the opposite set. This arrangement allows carrying out the winding on a plurality of spindles—called hereinafter a first set of spindles—facing the inner part of the machine, where the wireguides operate, while the unloading of the finished coils and the loading of the single empty coil supports can be carried out on another plurality of spindles—called hereinafter a second set of spindles—facing outwardly towards the operator.

The advantage of such an arrangement is obvious, as it allows eliminating the dead times of the loading and unloading operations: in fact, at the end of the winding of a plurality of coils, the bed is tilted by 180°—obviously, in a very short lapse of time, which is practically neglectable as compared to the time required for winding the coils—and the winding of another plurality of coils is started at once, while the unloading and loading operations are carried out on the front of the machine.

In most of the known coil winders in line, each set of spindles is controlled in a substantially independent manner, so that the rotation of the spindles of the first set by no means affects the rotation of the spindles of the second set, and these latter can be held stationary for the loading and unloading operations, while the first ones rotate to carry out the winding.

According to a first known arrangement, the motion transmission controlling the rotation of the first set of spindles, namely those facing the inside of the machine, comprises a plurality of driving shafts, carried by the stationary part of the machine, each shaft having an end adapted to engage with the end of a corresponding spindle—for example by a groove-and-tongue joint—in order to drag it directly into rotation. In this manner, the spindles of the second set, namely those facing the operator, are necessarily disengaged from said driving shafts.

According to a further known arrangement, the spindles of a first set are mutually interconnected by a motion transmission housed inside the bed or crosspiece; a second motion transmission—totally independent from the first—moreover mutually connects the spindles of the second set. Each of the two motion transmissions is connected to a respective driven shaft, also housed inside the bed. Each of the two driven shafts—independent one from the other in rotation—comprises an end outwardly projecting from the bed and carrying a first clutch portion, for instance a male connector, with which cooperates a second clutch portion, namely a female connector, fixed to the end of the main driving shaft of a motor unit mounted on the stationary part of the machine.

To carry out the winding, said driving shaft is engaged on the driven shaft of the motion transmission of the first set of spindles, to cause the rotation thereof, while the driven shaft of the second set of spindles is obviously disengaged from said driving shaft and the corresponding spindles are positioned for the loading and unloading operations.

SUMMARY OF THE INVENTION

The object of the present invention is to provide a coil winder in line of the aforementioned type, which is adapted to perform not only the well known operations of this type of machine—namely, coil winding, and loading and unloading of the pieces—but also some supplementary or finishing operations on the wound coils (which have so far always been carried out, after the coils have been unloaded from the coil winder, on other machines positioned downstream thereof) and, above all, some intermediate operations on the coils being wound.

This result is obtained—on coil winders in line of the aforementioned type, which comprise at least two sets of spindles for coil support, mounted for rotation on a crosspiece or bed tilting by 180° about a horizontal axis which is transverse to the axes of the coil support spindles—by a process, according to which the spindles of each set are caused to rotate by two respective motion transmissions, which are alternatively led to cooperate with a main motor unit, to wind the coils mounted on the spindles facing the inside of the machine, characterized in that an intermediate and/or supplementary working stage is carried out, at least partly during winding of the first coils, on the coils mounted on the spindles facing the outer front part of the machine, by using the motion transmission associated to such spindles, as well as secondary motor means.

According to the present invention, a coil winder in line adapted to carry out the aforespecified process, is essentially characterized in that it comprises operating means acting on the front of the machine and adapted to carry out an intermediate and/or supplementary work operation on the coils mounted on the spindles of said second set.

More particularly, and according to a preferred characteristic of the present invention, said operating means mounted on the front of the machine first of all comprise secondary motor means, arranged in a symmetrically opposite position in respect of the main motor unit positioned inside the machine to control the winding, but completely independent therefrom, said secondary motor means being adapted to engage with the motion transmission driving the spindles of the second set, so as to control an at least partial rotation of said spindles according to the requirements of the intermediate and/or supplementary working stage on the coils.

BRIEF DESCRIPTION OF THE DRAWINGS

Further characteristics and advantages of the present invention will be more evident from the following description of a preferred embodiment thereof, illustrated by mere way of example in the accompanying drawings, in which:

FIG. 2A is a partial diagrammatic front view, of the same machine of FIG. 1, and FIG. 2B is a top plan view thereof;

DESCRIPTION OF THE PREFERRED EMBODIMENTS

Figure 4:
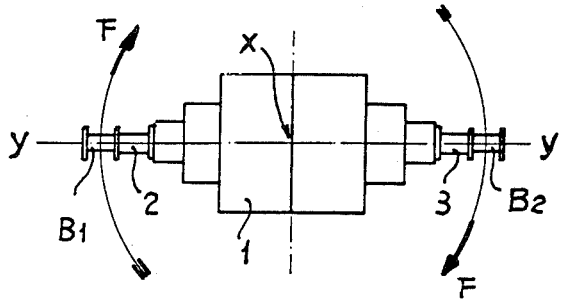
FIG. 4 is a diagrammatic view from the right of FIG. 3.

In the drawings, the coil winder in line—being a machine of known type—has been represented only for the part concerning the invention, namely the main frame T and the tilting bed 1. As indicated by the arrows F, the bed 1 can be caused to rotate about the horizontal axis X, to take up two symmetrical working positions, namely the position shown in FIG. 1 and a position rotated by 180° in respect of that shown in FIG. 1.

On the bed 1 there are mounted two opposed sets of spindles, rotating about parallel axes Y; reference 2 indicates the spindles of the first set, which face the inner part of the machine to allow—in known manner—the winding of the coils, while reference 3 indicates the spindles of the second set, which are positioned on the front side of the machine, facing outwardly towards the operator.

As already mentioned, in the coil winders in line of the prior art while the spindles 2 are working and are caused to rotate so as to carry out the winding on the coils $B_1$, the operator unloads the already wound coils $B_2$ and loads the empty coil supports on the spindles 3 which are waiting. Once the winding has been completed, the bed 1 is tilted by 180°, so that the wound coils $B_1$ are carried to the front waiting position and the empty coils $B_2$ are carried to the inner working position.

Hereinafter, reference is always made to the spindles 2 as the spindles of the first set, in a working position, and to the spindles 3 as the spindles of the second set, in a waiting position.

According to the embodiment shown in the drawings—given by way of preferred example and in no way limiting the invention—on the front of the coil winder there is arranged an operating unit, adapted to perform a "taping" operation, that is, to apply one or more layers of protective tape on the completed coil winding, or one or more layers of tape to separate two successive coil windings.

This taping unit essentially comprises:

the one hand, a device to feed adhesive tape towards the coil $B_2$ and to apply the end of said tape against the surface of the coil winding; and on the other hand, motor means—hereinafter called secondary motor means to cause the rotation of the coil, for example by one turn or by plural turns or turn fractions, so that it drags into rotation said adhesive tape, one or more layers of which are thus applied on the winding.

The device feeding adhesive tape comprises (see particularly FIG. 2) a plurality of rolls 4 feeding the tape 5, and precisely one roll 4 for each spindle 3. With each roll 4 there are associated means 6, to guide the tape towards said spindle 3, and a pressure pad 7, to apply the starting end 5' of the tape against the winding surface of the coil $B_2$. To retain the tape end 5' on the pad 7, this latter is for instance provided with vacuum means (not shown, but known per se). To the side of the pad 7 there is possibly provided a presser 7A, allowing a steadier application of the tape end 5' on the coil, also in a manner known per se.

Figure 1:
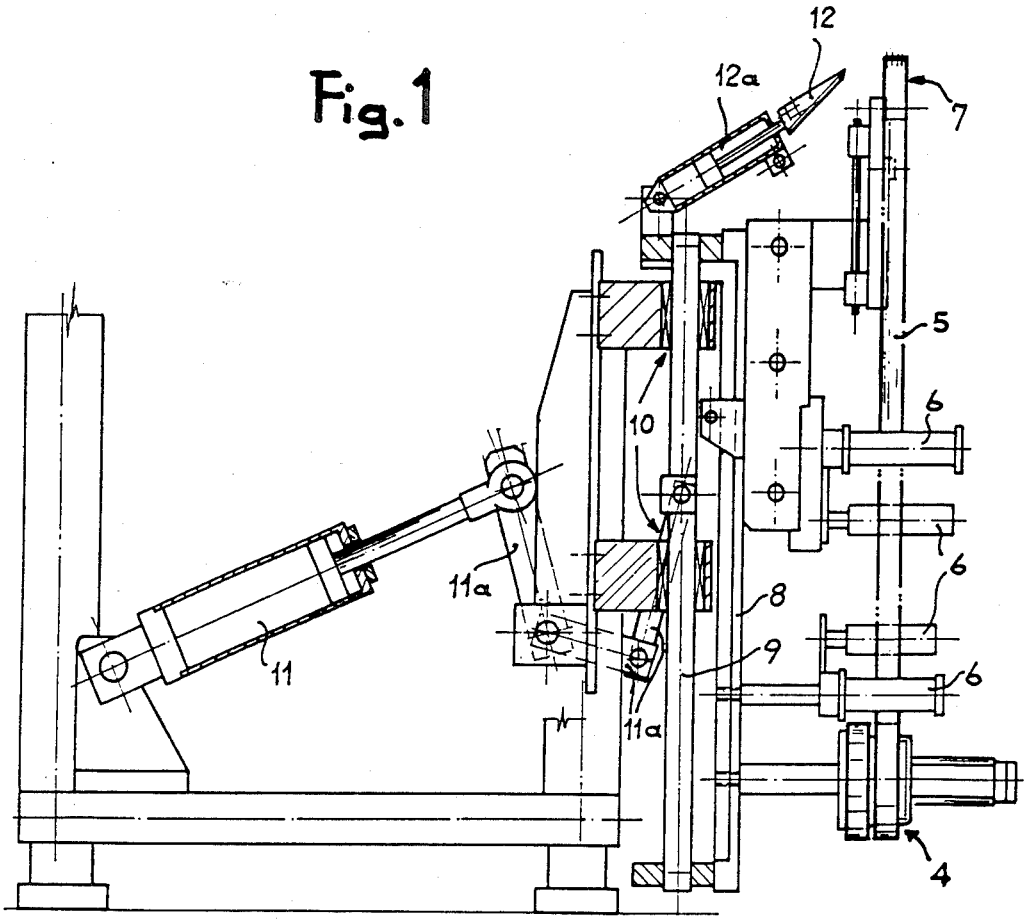
FIG. 1 is a lateral part section view, showing part of the coil winder in line with a front operating unit, according to the invention.

As shown in FIG. 1, the means 4, 6, 7 feeding the tape 5 are mounted on a common support carriage 8 which is vertically slidable, through guide bars 9, in bearings 10 fixedly connected to the main frame T. A cylinder 11 and transmission levers 11a control the carriage 8 in its upward motion—to apply the tape end 5' against the coil $B_2$ and allow the winding of one or more layers of tape 5—and, respectively, in its downward motion, to move the taping unit away from the bed 1 before tilting this latter.

The taping unit also comprises a cutting device 12 for the tape 5, for instance controlled by means of a respective cylinder 12*a*, which is operated just before moving the taping unit away from the coil $B_2$.

Figure 3:
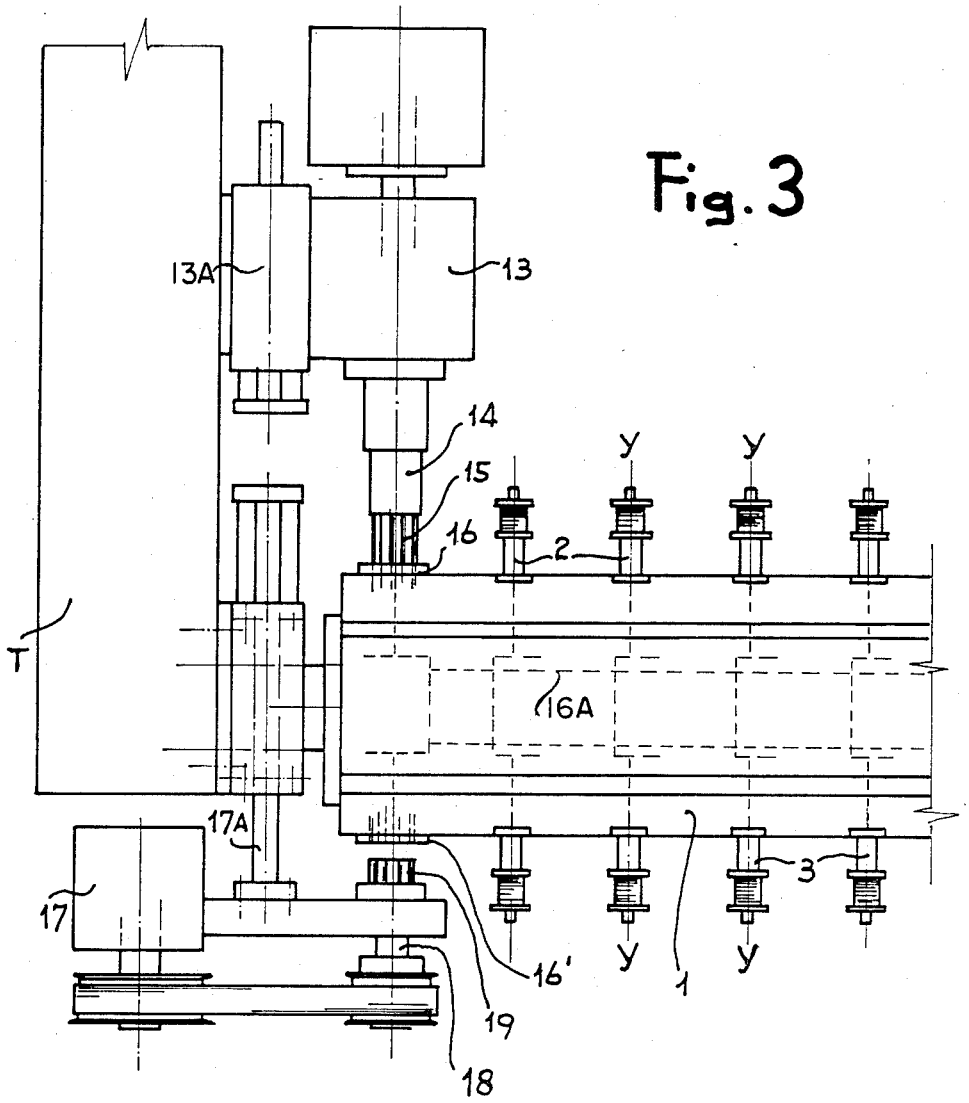
FIG. 3 is a partial diagrammatic plan view of said machine.

FIG. 3 shows the motor means—hereinafter called "main motor unit"—which control the winding of the coils on the spindles 2. These comprise a motor unit 13, from which projects—in a manner known per se—shaft 14 ending with a male clutch 15, adapted to cooperate with a female clutch 16 of a driven shaft connected to a motion transmission 16A driving the spindles 2, said motion transmission being housed in the bed 1.

This main motor unit is mounted—also in known manner—slidable parallel to the axis of the shaft 14, by means of a slide 13A, so as to be able to disengage the clutch 15 from the clutch 16 when having to tilt the bed 1 by 180°, for the already described function.

According to the invention, motor means are also provided on the front of the machine—hereafter called "secondary motor means"—and these comprise a motor unit 17, which operates a shaft 18 ending with a male clutch 19, identical and symmetrical to the clutch 15. Also these secondary motor means are mounted slidable parallel to the axis of the shaft 18, by means of the slide 17A, so as to allow engagement and disengagement of the clutch 19 from a female clutch 16' controlling, symmetrically to the clutch 16, the rotation of the set of spindles 3.

Further according to the invention, the secondary motor means 17, 18 and 19, are adapted to cause the rotation of the spindles 3 by one or more turns or turn fractions, according to the requirements of the intermediate and/or supplementary work operations on the coils $B_2$.

As can be easily noted, these secondary motor means are thus adapted to cooperate—according to an advantageous aspect of the present invention—with a motion transmission already existing on the machine, and which was normally not used for the spindles 3 of the second set in the arrangements according to the prior art.

Through this arrangement it is now possible to operate, according to the present invention, in the following manner:

- on the spindles 2 of the first set the winding is carried out, in known manner, over a relatively long period of time;
- during the same time, on the spindles 3 of the second set, the following steps take place in succession:
  - engagement of the clutch 19 with the clutch 16',
  - feeding the adhesive tape end 5' to the winding of the coil $B_2$ and applying it thereon,
  - rotation of all the coils $B_2$ positioned on the spindles 3, through the motor 17, by one or more turns or turn fractions, with consequent winding of the tapes 5 around said coils,
  - cutting the tapes 5,
  - unloading the finished coils $B_2$,
  - loading the empty coil supports.

It should be noted that, under normal conditions, the time required to carry out this series of operations is less, or at the most equal to the time required to wind the coils on the spindles 2, so that it is actually possible to obtain wound and perfectly taped coils, without introducing dead times for these operations.

A particularly important advantage achieved by the present invention is to be able to carry out—for the first time on coil winders in line—an intermediate operation, for example a taping, i.e. the application of a layer of protective or insulating tape between distinct, successive coil windings. This operation is performed as follows:

- a first winding is carried out on the set of coils $B_1$ mounted on the spindles 2 (of course performing, as usual, the twisting of the winding ends on the coil terminals), while the empty supports of the coils $B_2$ are simultaneously loaded on the spindles 3;
- the bed is tilted by 180° and a first winding is carried out on the set of coils $B_2$, while a tape is simultaneously applied on the first winding of the coils $B_1$;
- the bed is again tilted by 180° and a second winding is carried out on the coils $B_1$, while a tape is simultaneously applied on the coils $B_2$;
- the bed is once more tilted by 180° and the second winding is carried out on the coils $B_2$, while the final protection tape is applied on the coils $B_1$, which are also unloaded and replaced by empty coil supports. These steps are then repeated.

Of course, the case mentioned herein refers to coils with two windings, separated by a layer of tape, but one can obviously proceed likewise to carry out as many successive windings, always separated by insulating tape, as are required.

It should here be noted that, up to date, the final taping operation on the wound coils has been carried out on a machine separate from the coil winder in line, which requires transferring the coils wound by the coil winder onto the taping machine, giving rise to difficulties and, in certain cases, additional dead times. Moreover, the intermediate taping operation, taking place between successive windings of the same coil, was impossible to carry out in practice, or could be carried out only with considerable difficulties and only through a transfer from the coil winder to the taping machine and a further transfer onto the coil winder.

The present invention is instead adapted to fully and brilliantly solve both these problems, by using on the other hand means—such as the motion transmission from the clutch 16' to the spindles 3—which are already provided for, but currently not used, on the coil winder.

The above specifically refers to the case in which an intermediate and/or supplementary operation, adapted to be carried out on the front of the machine, is a taping operation, this being the one mostly demanded. It is however to be understood that, as already said, the taping operation is a mere example and that other types of work operations can be carried out in the same manner—for instance, the hot fixing of the winding turns by rotating the coils $B_2$ in respect of hot air blasts sent from fixed positions, or the tinning of the coil terminals by equally rotating the coils in respect of molten tin baths set in a fixed position—while still remaining within the scope of the above inventive idea. Also the embodiment of the taping unit is a mere example and it is evident that a technician skilled in the art can easily introduce therein any modifications, without thereby departing from the scope of the present invention.

I claim:

1. A process for winding coils on a coil winding machine having an elongated horizontal bed that is rotatable about a horizontal axis extending lengthwise of the bed and has a line of spindles projecting outwardly from one side of the bed and a line of spindles projecting outwardly from the other side of the bed, the axes of the spindles all being parallel to each other and perpendicular to said horizontal axis, comprising winding filamentary material on the spindles on one side of the bed to produce a plurality of first coils, rotating the bed 180° about said horizontal axis, applying a tape to said coils, again rotating the bed 180° about said horizontal axis, winding at least one second said coils on said tape, again rotating the bed 180° about said horizontal axis, removing said first and at least one second coils with tape between them from said spindles, and again rotating the bed 180° about said horizontal axis, the steps of winding first and at least one second said coils being alternately performed on one side of said bed and the steps of taping and removing being alternately performed on an opposite side of said bed.

2. In an in-line coil winder of the type comprising an elongated horizontal bed mounted for rotation about a horizontal axis extending lengthwise of the bed and having a plurality of spindles extending outwardly from the bed in a line along one side of the bed and another plurality of spindles extending outwardly from the bed in a line on the opposite side of the bed, said spindles having their axes all parallel to each other and perpendicular to said horizontal axis, means to rotate the bed about said horizontal axis, and means for selectively simultaneously driving in rotation all of the spindles on one side of the bed, and means for selectively simultaneously driving in rotation all of the spindles on the opposite side of the bed; the improvement comprising taping means for applying tape to filamentary material on coils mounted on said spindles on said opposite side of said bed, during the time that said filamentary material is being wound on said coils on said spindles on said one side of said bed.

3. A coil winder as claimed in claim 2, in which said means for rotating said spindles comprise two motor-and-clutch assemblies one disposed on each side of said bed, and selectively individually movable toward and away from said bed thereby to engage a clutch of each motor-and-clutch assembly with drive means on said bed for the spindles on the associated said side of the bed.

4. A coil winder as claimed in claim 2, said taping means including severing means for severing a length of tape after it has been applied to a said coil.

5. A coil winder as claimed in claim 2, and means mounted on said coil winder for selectively bodily vertically moving said taping means up to a position for applying tape, and downward to an inoperative position.

* * * * *